US009750331B2

(12) United States Patent
Carver

(10) Patent No.: US 9,750,331 B2
(45) **Date of Patent: *Sep. 5, 2017**

(54) INTEGRATED MODULAR ATTACHMENT SYSTEM

(71) Applicant: 5 Seas Engineering & Trading LLC, Dittmer, MO (US)

(72) Inventor: John W. Carver, Dittmer, MO (US)

(73) Assignee: 5 Seas Engineering & Trading LLC, Dittmer, MO (US)

( * ) Notice: Subject to any disclaimer, the term of this patent is extended or adjusted under 35 U.S.C. 154(b) by 168 days.

This patent is subject to a terminal disclaimer.

(21) Appl. No.: 14/745,719

(22) Filed: Jun. 22, 2015

(65) Prior Publication Data

US 2016/0367016 A1 Dec. 22, 2016

(51) Int. Cl.

| | |
|---|---|
| ***A45F 5/02*** | (2006.01) |
| ***A45F 5/00*** | (2006.01) |
| *A45F 3/14* | (2006.01) |

(52) U.S. Cl.

CPC ..... *A45F 5/021* (2013.01); *A45F 5/00* (2013.01); *A45F 2003/144* (2013.01); *Y10S 224/9012* (2013.01)

(58) Field of Classification Search

CPC ..... A45F 5/02; A45F 5/021; F41C 33/041; Y10S 224/9012; Y10S 224/9016

USPC ..... 224/675, 901.2, 901.6

See application file for complete search history.

(56) References Cited

U.S. PATENT DOCUMENTS

| | | | | |
|---|---|---|---|---|
| 2,049,293 | A * | 7/1936 | Fink | A45F 5/021 224/675 |
| 3,557,384 | A * | 1/1971 | Barron | F41H 1/02 2/2.5 |
| 4,907,729 | A * | 3/1990 | Hess, III | A45C 1/04 224/240 |
| 5,259,093 | A | 11/1993 | D'Annunzio | |
| 5,586,701 | A * | 12/1996 | Kim | F41C 33/0227 224/236 |
| 5,693,006 | A * | 12/1997 | Slautterback | A61F 5/028 2/48 |
| 5,724,707 | A | 3/1998 | Kirk | |
| 6,185,738 | B1 | 2/2001 | Sidebottom | |
| 6,412,674 | B1 * | 7/2002 | Lipke | A45C 7/00 224/235 |
| 6,823,566 | B2 | 11/2004 | Coffey | |
| 7,266,850 | B1 | 9/2007 | Strum | |
| 7,963,427 | B2 * | 6/2011 | Calkin | A41D 13/0012 224/675 |

(Continued)

*Primary Examiner* — Justin Larson

(74) *Attorney, Agent, or Firm* — Husch Blackwell LLP

(57) ABSTRACT

An integrated modular attachment system for releasably attaching an object to a garment. The garment may include one or more loops. The object includes a base member, a foldable flap attached to the base member, a first wing member extending from a first side of the base member and a second wing member extending from a second side of the base member. To secure the object to the garment, the foldable flap is arranged in downward position and inserted through at least one of the loops of the garment. The first wing member is folded into a position which overlaps a portion of the foldable flap and is removably secured to the foldable flap. The second wing member is then folded over to overlap the first wing member and is removably secured to at least the first wing member.

6 Claims, 5 Drawing Sheets

(56) References Cited

U.S. PATENT DOCUMENTS

| | | | | |
|---|---|---|---|---|
| 8,087,560 | B2 * | 1/2012 | Crye | A45F 5/02 224/660 |
| 8,225,976 | B2 * | 7/2012 | Meunier | A45F 5/02 224/672 |
| 8,453,898 | B2 * | 6/2013 | Ewins | A45F 5/02 224/675 |
| 8,474,673 | B2 * | 7/2013 | Murdoch | A45F 5/02 224/672 |
| 9,427,069 | B1 * | 8/2016 | Carver | A45F 5/00 |
| 2006/0237509 | A1 * | 10/2006 | Moore | A45F 3/14 224/675 |
| 2007/0107109 | A1 | 5/2007 | Johnson | |
| 2007/0289045 | A1 | 12/2007 | Evans | |
| 2008/0251552 | A1 * | 10/2008 | Bell | A45F 3/16 224/250 |
| 2016/0367016 | A1 * | 12/2016 | Carver | A45F 3/14 |

* cited by examiner

INTEGRATED MODULAR ATTACHMENT SYSTEM

FIELD OF THE INVENTION

The present invention relates to an integrated modular attachment system which can be used to attach various objects to garments and, more particularly, an attachment system which allows for the secure attachment of removable pockets, pouches, sheathes, holsters, devices, or other objects to a textile surface of a garment like a belt, vest, pants, backpacks, luggage, or other items.

BACKGROUND OF THE INVENTION

It is well recognized that all types of modular load-bearing belts, vests, and backpacks with modular pockets or pouches employ some type of fastening system to hang the removable pockets or pouches or other objects therefrom. More specifically, on military and civilian load-bearing vests, backpacks, and tool belts there is a need to be able to position necessary pockets or pouches or other such objects where they are most useful to the individual user.

Examples of such type of hardware employed for this task includes the use of hook and loop fasteners, carabineers, keepers with slides, buttons, snap fasteners and soft snap devices. Generally the problems associated with these past methods and devices are the creation of unstable loads, bunching of items in one general location, unreliability, and expense. Furthermore, past systems are generally bulky and uncomfortable to the user.

Pockets or pouches that are sewn onto a vest cannot be repositioned and may not be useful to the user. In addition, pockets which form a permanent part of a vest or other garment, when they become worn, are completely useless. Some removable attachment systems have been developed, such as the one set forth in U.S. Pat. No. 5,724,707 (the "'707 patent") which involves intricate weaving of strapping to secure an object to a garment. While an improvement, this multiple layer strap weaving system is cumbersome and involves a significant amount of time to install.

The attaching system of the '707 patent attempted to improve upon a metal slide keeper to hang canteens and ammunition pouches on equipment belts used by the military. The '707 patent described the slide keeper as superior to other available technologies such as snap fasteners, hook and loop fasteners, buttons, and hooks, however, such prior fasteners are difficult to engage, heavy, costly, and subject to failing. These metal slide keepers also tend to protrude into the user causing discomfort.

There are also shortcomings in other mechanical methods of attachment. In particular, metal and plastic hardware generally rely on some mechanical means to be engaged or disengaged, and are bulky and thus cause discomfort to the user. Plastic and hardware fasteners also require activating a release bar or depressing levers or buttons. For certain applications, hook and loop fasteners can be noisy when disengaged which is a concern to military personnel and sportsmen. Snap fasteners are also very unreliable and likely to prematurely release. Another fault of snap fasteners is that they only secure two items together in an exact location, which limits the customizable benefits of removable pockets and pouches.

It is clearly evident that a need exists for a lightweight, low bulk (that is flat against the user), reliable, and secure fastener. A challenge exists in designing a stable attachment device for removable pockets or pouches on load-bearing vests, sportsman's vests, luggage, backpacks, tool belts and other items in which the removable pocket or pouch is substantially as stable as being permanently sewn to the mounting surface while maintaining low bulk, and reliability.

It is therefore an object of the invention to provide an integrated modular attachment system which is readily usable to adhere an object to a garment.

It is another object of the present invention to provide an integrated modular attachment system which can be utilized to removably attach objects, such as pockets or pouches and the like, to a main garment.

It is still another object of the present invention to provide an integrated modular attachment system that has a slim profile so as to prevent irritation to the user.

BRIEF SUMMARY OF THE INVENTION

The present invention relates to an integrated modular attachment system for releasably attaching an object to a garment. In one embodiment, the object may be a sheath or pouch, and the garment may be a belt. However, there are many applications for the present integrated modular attachment system. The garment may include a strip of webbing coupled to the garment wherein the webbing forms one or more loops. An object may be releasably attached to the garment when the object is in a secured configuration.

The object may include a base member having a first end, a second end, a first side, a second side, and an interior surface. The object may also include a foldable flap having a first end, a second end, a loop engagement portion, and a securing area proximate to its second end. The first end of the foldable flap may be coupled to the interior surface of the base member. When the foldable flap is in a downward position, the foldable flap may lie substantially adjacent and parallel to the base member. The securing area of the foldable flap may also include a first securing mechanism that faces inwardly when the foldable flap is in the downward position.

The object may also include a first wing member that has a first surface and a second surface. The first wing member may be coupled to the first side of the base member and may extend substantially perpendicular to and away from the first side of the base member in a first open position. The first surface of the first wing member may be disposed in an opposing relationship to the wing securing mechanism of the securing area of the foldable flap in a closed position of the first wing member.

The object may also include a second wing member having a first surface and a second surface. The second wing member may be coupled to the second side of the base member and may also extend substantially perpendicular to and away from the second side of the base member in a second open position. The first surface of the second wing member may be disposed in an opposing and overlapping relationship with the second surface of the first wing member in a closed position of the second wing member.

To secure the foldable flap, the first surface of the first wing member may include a second securing mechanism, the second surface of the first wing member may include a third securing mechanism, and the first surface of the second wing member may include a fourth wing securing mechanism. Accordingly, in the secured configuration of the object, the foldable flap may be in the downward position and pass through at least one of the loops of the garment to position the loop between the base member and the foldable flap. The first wing member may be moved toward its closed position so that the second securing mechanism of the first wing member matingly engages the first securing mechanism of the foldable flap. The second wing member may then be moved into its second closed position so that the fourth securing mechanism of the second wing member matingly engages the third securing mechanism of the first wing member. This arrangement releasably attaches the object to the garment in a secure manner and to remove the object from the garment, the steps merely need to be reversed.

Other aspects and advantages of the present invention will be apparent to a person skilled in the art from the following detailed description of the various embodiments and the accompanying drawing figures.

Figure 1:
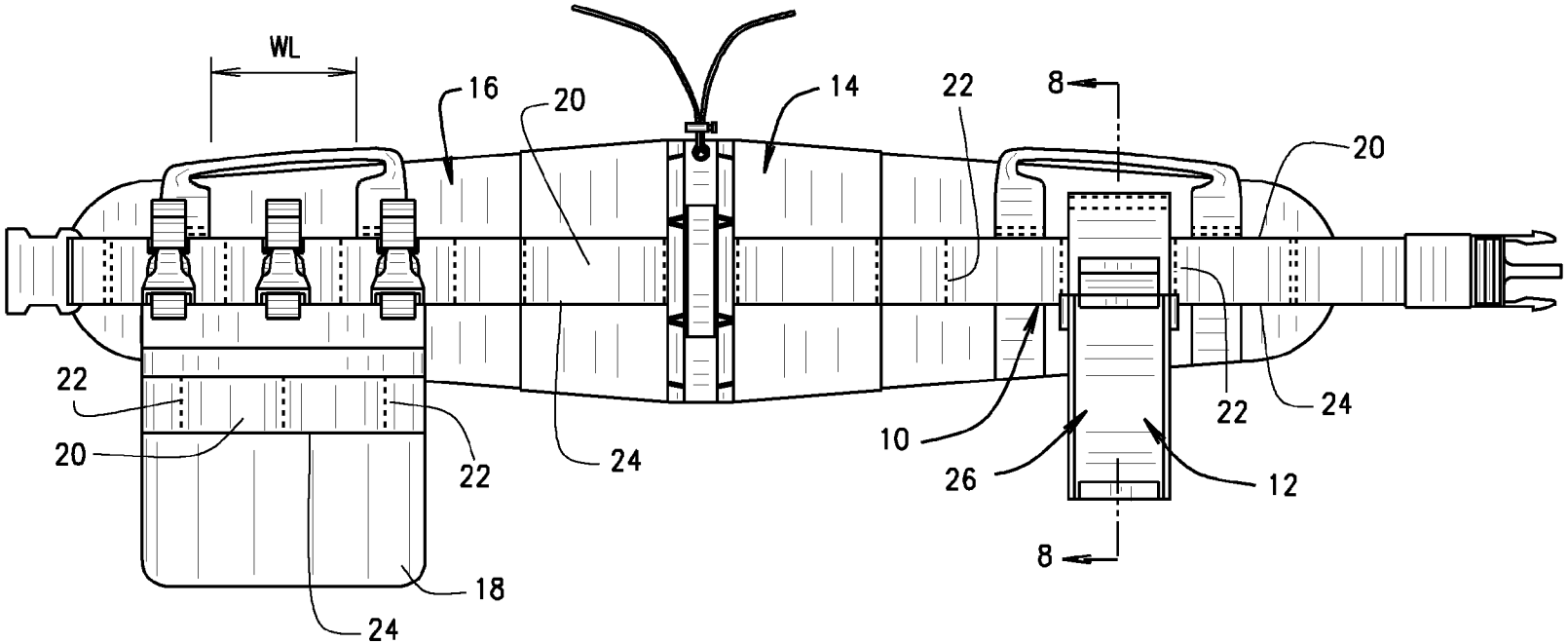
FIG. 1 is a side elevational view of a utility belt that includes an object, namely, a sheath/pouch attached thereto using the present integrated modular attachment system constructed in accordance with the teachings of one embodiment of the present invention.

While the disclosure is susceptible to various modifications and alternative forms, a specific embodiment thereof is shown by way of example in the drawings and will herein be described in detail. It should be understood, however, that the drawings and detailed description presented herein are not intended to limit the disclosure to the particular embodiment disclosed, but to the contrary, the intention is to cover all modifications, equivalents, and alternatives falling within the spirit and scope of the present disclosure as defined by the appended claims.

DETAILED DESCRIPTION OF THE INVENTION

The invention will now be described with reference to the drawing figures, in which like reference numerals refer to like parts throughout. For purposes of clarity in illustrating the characteristics of the present invention, proportional relationships of the elements have not necessarily been maintained in the drawing figures. As used herein, the term "inwardly" is used to refer to a portion, part, component or surface of a particular member which faces towards the garment when in a designated position, and the term "outwardly" is used to refer to a portion, part, component or surface of a particular member which faces away from the garment when in a designated position.

Referring to the drawings particularly by reference numbers wherein like numerals refer to like parts. FIG. 1 illustrates an embodiment of the present integrated modular attachment system 10 that generally allows for an object 12 to be attached to a garment 14. In FIG. 1, garment 14 may be a tool or other utility type belt 16. In addition, garment 14 may be any other piece of clothing or equipment, including but not limited to, a vest, a jacket, pants, a backpack, luggage, a harness, a seat or seat cover, a protective case, or any other application where the fastening of an object to another item or garment is desired.

As shown in FIG. 1, garment 14 may include at least one strip of webbing 20 attached to the garment 14 with stitching or other fastening means 22 to form one or more loops 24 along the length of the webbing 20. Loops 24 may have a width WL corresponding to the distance between stitching 22. Webbing 20 may be attached to garment 14 using any other coupling method such as, for example, fusing the webbing 20 to garment 14 at distinct points, using an adhesive, or a mechanical fastener such as a rivet or like fastener. As further shown in FIG. 1, object 12 may be a sheath or pouch 26 for holding a tool or any other item such as nails, screws, rivets, drill bits or the like. Alternatively, object 12 may be any other type of object including, but not limited to, a tool holster, an accessory pouch or a wide variety of other accessory devices known in the art. As further shown in FIG. 1, webbing 20 may be disposed in a horizontal position, although a vertical or angular orientation of the webbing is also within the scope of the present invention. One layer of webbing 20 may be disposed on garment 14, such as belt 16, or if garment 14 has some height, multiple layers or rows of webbing 20 disposed in a parallel or intersecting pattern may likewise be utilized to provide multiple locations and different levels for the attachment of one or more objects 12 to garment 14.

Figure 2:
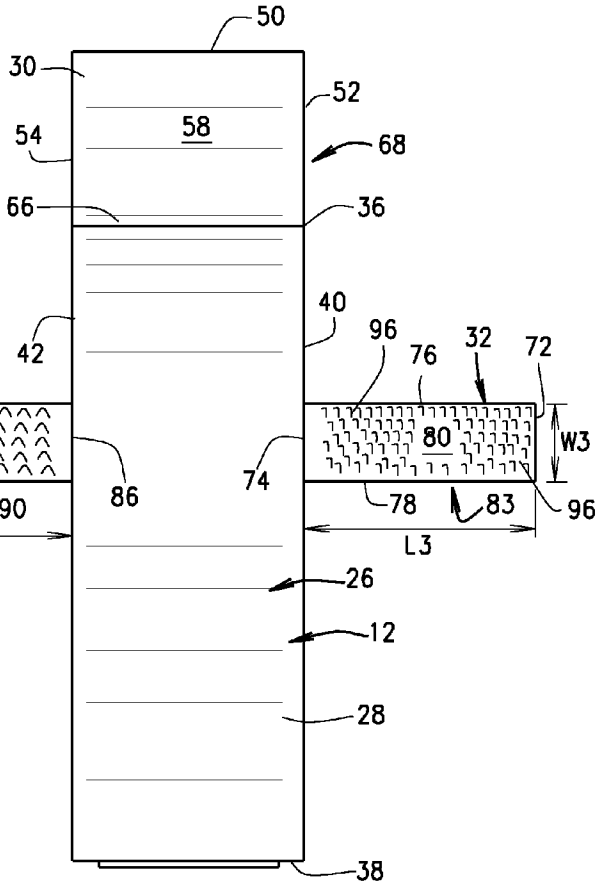
FIG. 2 is a rear elevational view of the object (sheath/pouch) including the components of the present integrated modular attachment system with the flap member in an upward position and the first and second wing members in an open position in accordance with the teachings of one embodiment of the present invention.
Figure 3:
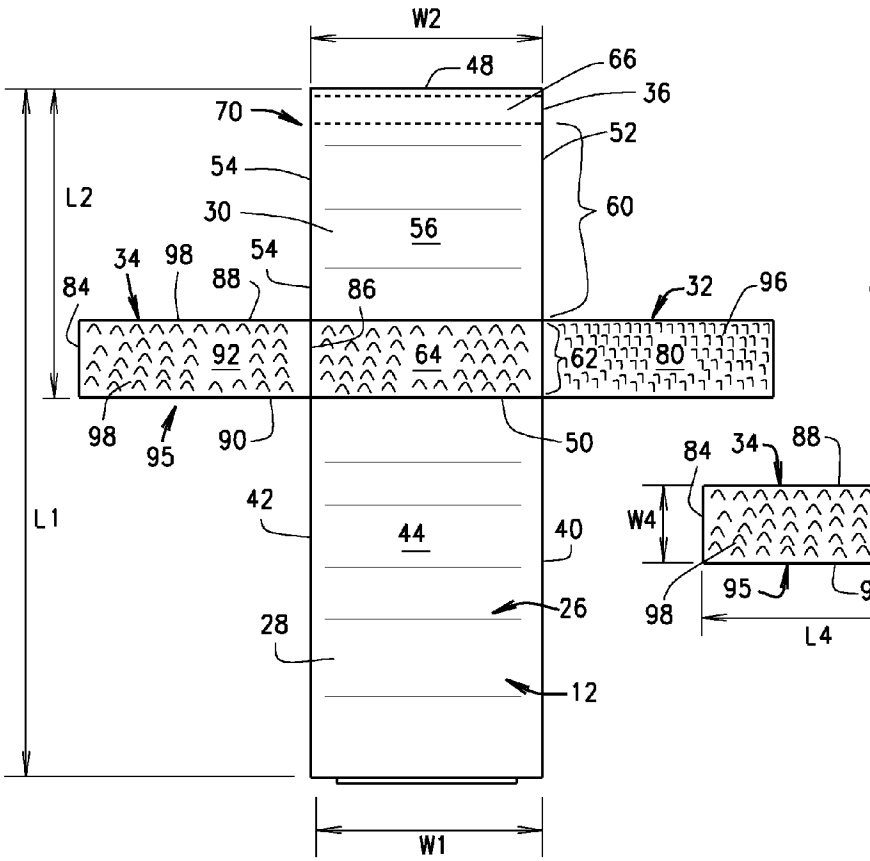
FIG. 3 is a rear elevational view of the object (sheath/pouch) of FIG. 2 wherein the flap member is in a down position.

Referring to FIG. 2, object 12 is illustrated as being a sheath/pouch 26 that includes a base member 28, a foldable flap 30, a first wing member 32 and a second wing member 34. Flap 30 is shown in its up or extended position in FIG. 2. As further shown in FIGS. 2 and 3, base member 28 includes a first end 36, a second end 38, a first side 40, a second side 42, an interior surface 44, and an exterior surface 46 (shown in FIG. 4). As shown in FIG. 3, first end 36 and second end 38 define a length L1 and first side 40 and second side 42 define a width W1 of the base member 28.

As best shown in FIG. 3, foldable flap 30, shown in its folded down position, includes a first end 48, a second end 50, a first side 52, a second side 54, an interior surface 56 and an exterior surface 58 (shown in FIG. 2). First end 48 and second end 50 define a length L2 of foldable flap 30 and first side 52 and second side 54 define a width W2 of foldable flap 30. Width W2 of foldable flap 30 is less than width WL (FIG. 1) of loops. 24. In addition, foldable flap 30 may include a loop engaging portion 60 disposed between first end 48 and second end 50, and a securing area 62 proximate second end 50. A wing securing mechanism 64 is disposed on the interior surface 56 of securing area 62 proximate second end 50. Wing securing mechanism 64 is preferably a mating surface of a hook and loop fastener known in the art, but may be any other mechanical fastening system. In the embodiment shown, wing securing mechanism 64 is a continuous strip of the loop portion of a hook and loop fastening system extending across substantially the entire width W2. The loop engaging portion 60 may include additional structural reinforcing means such as a polymer insert between fabric layers or any other treatment which reinforces and/or stiffens the material of foldable flap 30 proximate the loop engaging portion 60.

As shown in FIG. 3, first end 48 of foldable flap 30 is coupled proximate first end 36 of base member 28 at joint 66. Joint 66 may be a coupling of two separate pieces with a sewn, fused, or any other mechanical coupling method known in the art. Joint 66 may alternatively be created by a fold in a single piece of material. Alternative embodiments may include a foldable flap 30 coupled to base member 28 at any position along its length L1, not just proximate first end 36 of base member 28 as shown. The joining of flap 30 and base member 28 renders flap 30 foldable about joint 66 between an up or extended position 68 illustrated in FIG. 2, and a down position 70 illustrated in FIG. 3. When disposed in its down position 70, the second end 50 of foldable flap 30 is positioned between first end 36 and second end 38 of base member 28 and securing area 62 and wing securing mechanism 64 are substantially at the same location along length L1 of base member 28 as first wing member 32 and second wing member 34. Thus, securing area 62, first wing member 32 and second wing member 34 are substantially aligned on an axis perpendicular to the length L1.

Figure 4:
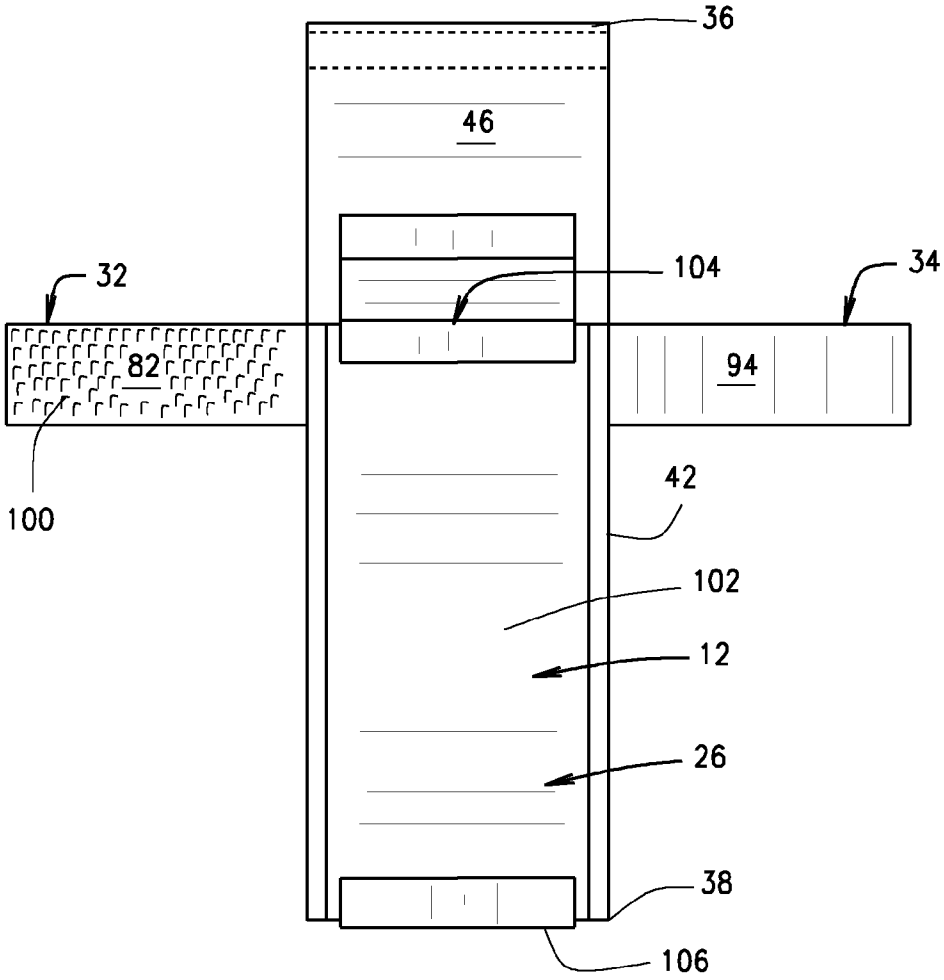
FIG. 4 is a front elevational view of the object (sheath/pouch) of FIG. 2 wherein the flap member is in the down position and the first and second wing members are in an open position.

As best shown in FIG. 2, first wing member 32 includes a first end 72, a second end 74, a top side 76, a bottom side 78, a first surface 80, and a second surface 82 (shown in FIG. 4). First end 72 and second end 74 define a length L3 and top side 76 and bottom side 78 define a width W3 of first wing member 32. Second end 74 of first wing member 32 is coupled to first side 40 of base member 28 and first wing member 32 extends substantially perpendicular to first side 40 of base member 28 in an open position 83. Second end 74 of first wing member 32 is sufficiently secured with respect to base member 28 to allow first wing member 32 to be folded about the first side 40 of base member 28.

Similarly, second wing member 34 includes a first end 84, a second end 86, a top side 88, a bottom side 90, a first surface 92, and a second surface 94 (shown in FIG. 4). First end 84 and second end 86 define a length L4, and top side 88 and bottom side 90 define a width W4 of second wing member 34. Second end 86 of second wing member 34 is coupled to second side 42 of base member 28 and second wing member 34 extends substantially perpendicular to second side 42 of base member 28 in an open position 95. Second end 86 of second wing member 34 is sufficiently secured with respect to base member 28 to allow the second wing member 34 to be folded about the second side 42 of base member 28. First wing member 32 and second wing member 34 may be individual members wherein each member is coupled to base member 28 separately, or first wing member 32 and second wing member 34 may be a single elongated member which is coupled to base member 28 so as to define both first wing member 32 and second wing member 34. Length L3 of first wing member 32 and length L4 of second wing member 34 are substantially the same and will correspond or will be substantially similar to width W2 of foldable flap 30. In another embodiment, length L3 of first wing member 32 is longer than width W2 to account for folding over onto foldable flap 30, and length L4 of second wing member 34 is longer than length L3 to account for overlap when folded over first wing member 32 as will be hereinafter explained. Alternatively, length L3 of first wing member 32 and length L4 of second wing member 34 may be different and may be longer or shorter than each other and/or width W2 of foldable flap 30.

As further shown in FIGS. 2 and 3, first wing member 32 includes a first fastening mechanism 96 disposed on its first surface 80 and second wing member 34 includes a fastening mechanism 98 on its first surface 92. As shown in FIG. 4, first wing member 32 further includes a second fastening mechanism 100 disposed on its second surface 82. In the embodiment shown in FIGS. 2, 3, and 4, first fastening mechanism 96 (FIGS. 2 and 3) and second fastening mechanism 100 (FIG. 4) of first wing member 32 is a continuous strip of the hook portion of a hook and loop fastening system. As shown in FIGS. 2 and 3, first fastening mechanism 98 of first surface 92 of second wing member 34 can be a continuous strip of the loop portion of a hook and loop fastening system. Alternatively, first fastening mechanism 96 may be either of the mating surfaces of a hook and loop fastener known in the art, or may be any other mating mechanical fastening system like a snap, clip, or other releasable mechanical fastener which is configured to mate with and releasably secure first surface 80 of first wing member 32 with wing securing mechanism 64 of foldable flap 30. Similarly, second fastening mechanism 100 of second surface 82 of first wing member 32 may be either of the mating surfaces of a hook and loop fastener known in the art, or may be any other mating mechanical fastening system like a snap, clip, or other releasable mechanical fastener which is configured to mate with and releasably secure second surface 82 of first wing member 32 with first fastening mechanism 98 of first surface 92 of second wing member 34.

FIG. 4 illustrates the front elevational view of the sheath/pouch 26 (object 12) wherein sheath/pouch 26 includes a pouch 102, an open top 104, and a closed bottom 106. FIG. 1 shows sheath/pouch 26 disposed on belt 16 so that closed bottom 106 is downward of open top 104. This allows a tool or other item(s) to be stored in sheath/pouch 26.

Figure 6:
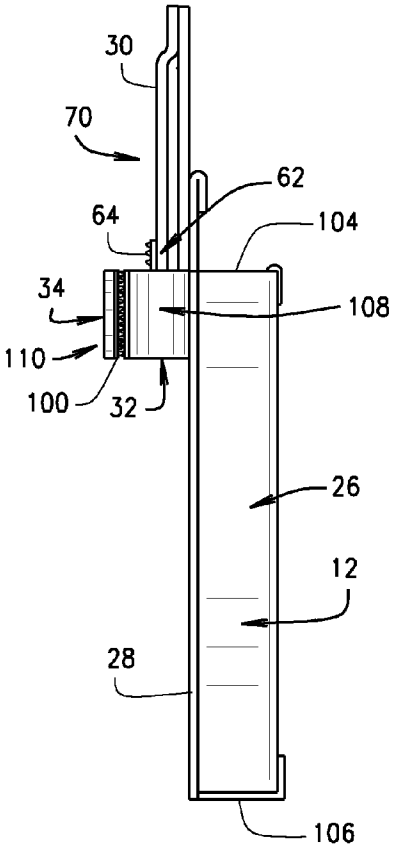
FIG. 6 is left side elevational view of the object (sheath/pouch) of FIG. 5.
Figure 7:
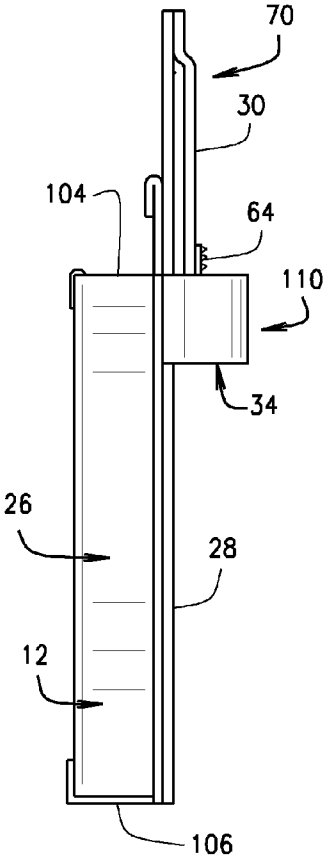
FIG. 7 is right side elevational view of the object (sheath/pouch) of FIG. 5.
Figure 5:
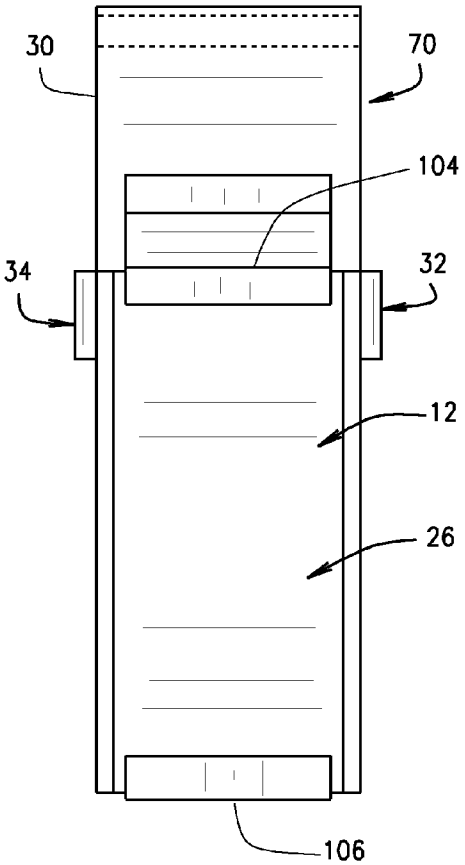
FIG. 5 is a front elevational view of the object (sheath/pouch) of FIG. 2 with the flap member in a down position and the first and second wing members in a closed position in accordance with the teachings of one embodiment of the present invention.

FIGS. 5, 6, and 7 show object 12 or sheath/pouch 26 with foldable flap 30 in its down position 70 as best shown in FIGS. 6 and 7, first wing member 32 in its closed position 108, and second wing member 34 also in its closed position 110. As best shown in FIG. 6, first wing member 32 is folded against at least a portion of securing area 62 of foldable flap 30 so that first securing mechanism 96 (not shown) of first wing member 32 engages wing securing mechanism 64. In addition, second wing member 34 is folded over and against first wing member 32 so that first securing mechanism 98 of second wing member 34 engages second securing mechanism 100 of first wing member 32. In addition, in the down position 70, foldable flap 30 lies substantially parallel and adjacent to base member 28. FIG. 7 illustrates how second wing member 34 folds over both first wing member 32 (hidden) and foldable flap 30.

Figure 8:
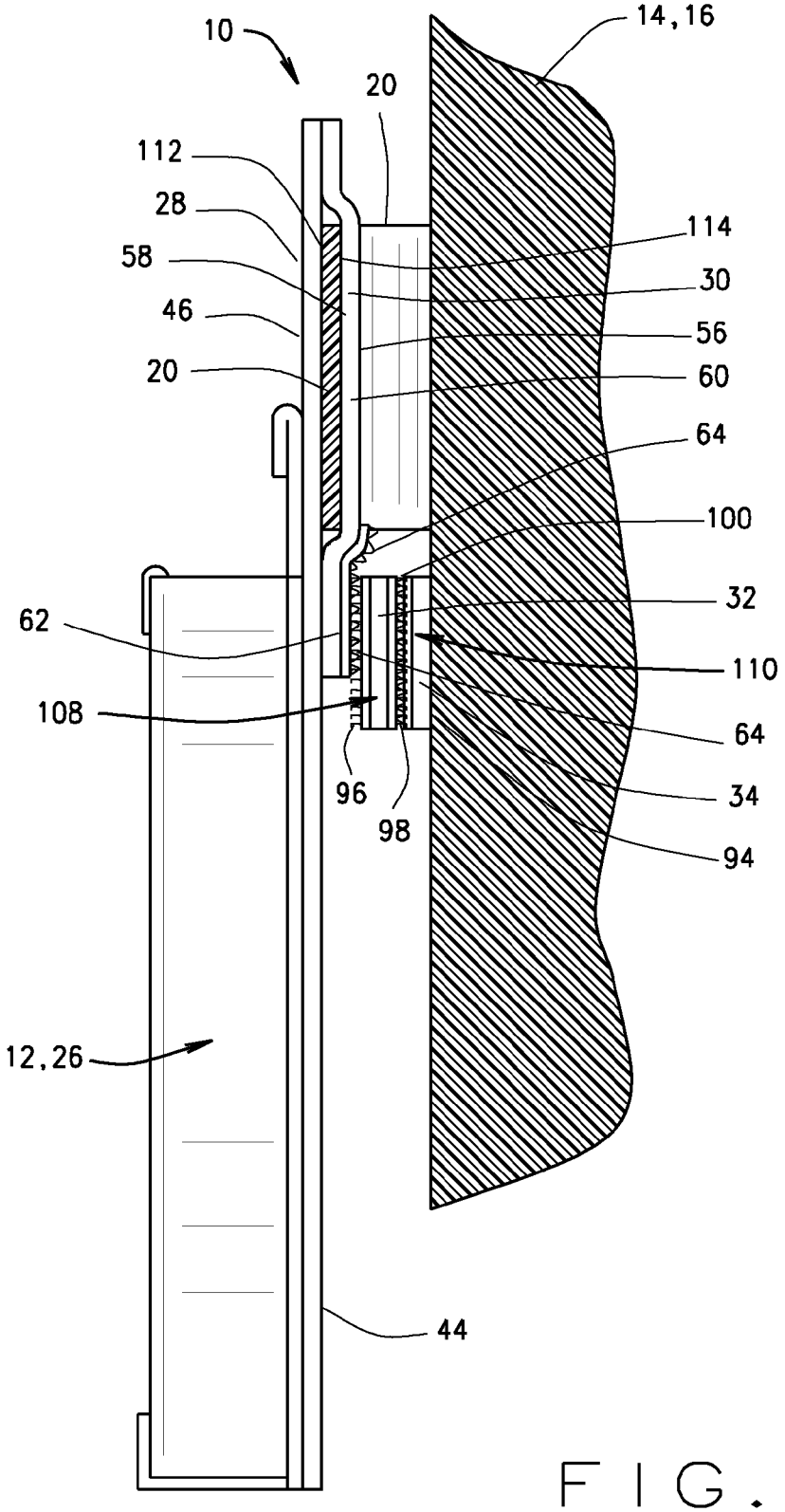
FIG. 8 is a cross sectional view of the belt and object (sheath/pouch) coupled together with the present integrated modular attachment system taken along the line 8-8 of FIG. 1.

FIG. 8 illustrates the integrated modular attachment system 10 of the present invention connecting object 12 to garment 14. More particularly, FIG. 8 illustrates attaching sheath/pouch 26 to belt 16 using the present integrated modular attachment system 10. To attach object 12 to garment 14, foldable flap 30 is first inserted through one of the loops 24 of webbing 20 such that interior surface 44 of base member 28 touches an outer surface 112 of webbing 20, exterior surface 58 of foldable flap 30 contacts an inner surface 114 of webbing 20, and interior surface 56 of foldable flap 30 opposes garment 14. Securing area 62 of foldable flap 30 clears loop 24 and extends away from loop 24 exposing wing securing mechanism 64. At this point, first wing member 32 is folded from its open position (see 83, FIG. 2) to its closed position 108 and pressed against securing area 62 of foldable flap 30 so that first wing securing mechanism 96 of first wing member 32 can be pressed against or otherwise engages wing securing mechanism 64 of foldable flap 30 to releasably secure first wing member 32 against foldable flap 30. First wing member now overlaps at least a portion of securing area 62 of foldable flap 30. After first wing member 32 is releasably secured to foldable flap 30, second wing member 34 is folded from its open position (see 95, FIG. 2) to its closed position 110 to overlap first wing member 32. Second wing member 34 may be pressed against or otherwise engaged with first wing member 32 so that first wing securing mechanism 98 of second wing member 34 engages the second wing securing mechanism 100 of first wing member 32 to releasably secure second wing member 34 against first wing member 32. At this point, object 12 is securably attached to garment 14. The object 12 can be removed from garment 14 by simply reversing the steps above.

From the foregoing description, it is well within the skill of a person skilled in the art to include an embodiment of the present invention (not shown) which may be used to attach wider objects to a garment wherein the object includes more than one foldable flap disposed along the width of the object. In this embodiment, each flap will be separately inserted through an adjacent loop 24 on the garment. In one embodiment, a single first wing member may be disposed at one side of the base member of the wide object and a single second wing member may be disposed at the opposing side of the base member wherein the length of the first wing member is such that it spans across substantially the width of the object to simultaneously engage all of the foldable flaps in their downward position and the length of the second wing member is such that it overlaps substantially the entire length of the first wing member. In another embodiment, each foldable flap may have a corresponding set of a first wing member and a second wing member attached to said base member on either side of each foldable flap to secure each flap individually with respect to its corresponding loop.

It is also recognized and anticipated that the present integrated modular attachment system including loops 24, flap member 30, first wing member 32 and second wing member 34 can be incorporated into any garment and object as explained above. It is also recognized and anticipated that the size and shape of the loops 24, flap member 30, first wing member 32 and second wing member 34 including the size and shape of the corresponding securing mechanism 64 and fastening mechanisms 96, 98 and 100 can likewise take on a wide variety of different sizes and shapes depending upon the particular garment and object involved. Still further, the overlapping locking mechanism associated with the fastening arrangement described with respect to first wing member 32 and second wing member 34 provides a tight and secure fastening arrangement which is extremely difficult to become inadvertently disengaged when an object is attached to a garment in accordance with the teachings of the present invention due to the overlapping attachment arrangement of wing members 32 and 34. It is also recognized and anticipated that the width of the loops WL can take on a wide variety of different widths and each loop 24 can accommodate one or more flaps 30 depending upon the particular application. The present integrated modular attachment system is much simpler in overall structure, much easier to quickly attach an object to a garment, and in many cases provides a more secure attachment than the attachment system disclosed in U.S. Pat. No. 5,724,707. Other arrangements and combinations of the various elements of the present integrated modular attachment system are likewise envisioned and anticipated.

Thus, there has been shown and described several embodiments of a novel integrated modular attachment system. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications, which do not depart from the spirit and scope of the invention, are deemed to be covered by the invention which is limited only by the claims which follow.

The invention claimed is:

1. An integrated modular attachment system comprising:

a garment including one or more loops disposed on said garment;

an object being releasably attached to said garment in a secured configuration of said object, said object comprising a base member having a first end, a second end, a first side, a second side, an interior surface and an exterior surface;

a foldable flap coupled to said base member, said foldable flap having a first end, a second end, and a securing area proximate said second end, said securing area including a first securing mechanism, said foldable flap being foldable to a downward position wherein said flap extends parallel to the interior surface of said base member and said first securing mechanism lies between the first and second ends of said base member;

a first wing member coupled to the first side of said base member at a location in alignment with said first securing mechanism when the foldable flap is in its downward position, said first wing member having a first surface including a second securing mechanism and a second surface including a third securing mechanism, said first wing member overlapping said foldable flap in a first closed position when the foldable flap is in its downward position such that the second securing mechanism matingly engages the first securing mechanism; and a second wing member coupled to the second side of said base member at a location in alignment with said first securing mechanism when the foldable flap is in its downward position, said second wing member having a first surface including a fourth securing mechanism, said second wing member overlapping said first wing member in a second closed position when the foldable flap is in its downward position and said first wing member overlaps said foldable flap in its first closed position such that the fourth securing mechanism matingly engages the third securing mechanism;

wherein said secured configuration of said object includes positioning said foldable flap in its downward position and inserting it through at least one of said loops of said garment, positioning said first wing member in its first closed position and positioning said second wing member in its second closed position.

2. The integrated modular attachment system of claim 1 wherein the first and fourth securing mechanisms are a loop portion of a hook and loop fastener, and said second and third securing mechanisms are a hook portion of a hook and loop fastener.

3. An integrated modular attachment system comprising:

a belt including one or more loops coupled to said belt;

a pouch being releasably attached to said belt in a secured configuration of said pouch, said pouch comprising:

a base member having a first end, a second end, a first side, a second side, an interior surface and an exterior surface;

a foldable flap coupled proximate to a first end of said base member, said foldable flap having a first end, a second end, and a securing area proximate said second end, said securing area including a first securing mechanism, said foldable flap being folded into a downward position wherein said flap extends parallel to the interior surface of said base member and said first securing mechanism lies between the first and second ends of said base member;

a first wing member coupled to the first side of said base member at a location in alignment with said first securing mechanism when the foldable flap is in its downward position, said first wing member extending substantially perpendicularly and away from the first side of said base member in a first open position and having a first surface including a second securing mechanism and a second surface including a third securing mechanism, said first wing member overlapping said foldable flap in a first closed position when the foldable flap is in its downward position such that the second securing mechanism matingly engages the first securing mechanism; and and a second wing member coupled to the second side of said base member at a location in alignment with said first securing mechanism when the foldable flap is in its downward position, said second wing member extending substantially perpendicularly and away from the second side of said base member in a second open position and having a first surface including a fourth securing mechanism, said second wing member overlapping and removably secured to said first wing member in a second closed position when the foldable flap is in its downward position and said first wing member overlaps said foldable flap in its first closed position such that the fourth securing mechanism matingly engages the third securing mechanism;

wherein said secured configuration of said pouch includes positioning said foldable flap in its downward position and inserting it through one of said one or more loops coupled to said belt to position said one of said one or more loops between said foldable flap and said base member, positioning said first wing member in said first closed position releasably secured to said foldable flap, and positioning said second wing member in said second closed position releasably secured to at least said first wing member.

4. The integrated modular attachment system of claim 3 wherein the first and fourth securing mechanisms are a loop portion of a hook and loop fastener, and said second and third securing mechanisms are a hook portion of a hook and loop fastener.

5. An integrated modular attachment system comprising:

a garment including one or more loops associated therewith;

an object being releasably attached to said garment in a secured configuration of said object, said object comprising:

a base member having a first end, a second end, a first side, a second side, and an interior surface;

a foldable flap having a first end, a second end, a loop engagement portion and a securing area proximate said second end, said first end of said foldable flap being coupled to the interior surface said base member, said foldable flap being foldable to a downward position wherein said flap lies substantially adjacent and parallel to the interior surface of said base member, and said securing area including a first securing mechanism lying between the first and second ends of said base member in its downward position;

a first wing member having a first surface including a second securing mechanism and a second surface including a third securing mechanism, said first wing member coupled to the first side of said base member at a location in alignment with said first securing mechanism when the foldable flap is in its downward position, said first wing member extending substantially perpendicular to and away from the first side of said base member in a first open position, said first first wing member overlapping said foldable flap in a first closed position when the foldable flap is in its downward position such that the second securing mechanism matingly engages the first securing mechanism; and a second wing member having a first surface including a fourth securing mechanism and a second surface, said second wing member coupled to the second side of said base member at a location in alignment with said first securing mechanism when the foldable flap is in its downward position, said second wine member extending substantially perpendicular to and away from the second side of said base member in a second open position, said second wing member overlapping said first wing member in a second closed position when the foldable flap is in its downward position and said first wing member overlaps said foldable flap in its first closed position such that the fourth securing mechanism matingly engages the third securing mechanism;

wherein said secured configuration of said object includes positioning said foldable flap in its downward position and passing it through at least one of said loops of said garment so as to position said loop between said base member and said foldable flap, positioning said first wing member in said first closed position wherein said second securing mechanism of said first wing member matingly engages said first securing mechanism of said foldable flap, and positioning said second wing member in said second closed position wherein said fourth securing mechanism of said second wing member matingly engages said third securing mechanism of said first wing member.

6. The integrated modular attachment system of claim 5 wherein the first and fourth securing mechanisms are a loop portion of a hook and loop fastener, and said second and third securing mechanisms are a hook portion of a hook and loop fastener.

* * * * *